US007987618B2

(12) United States Patent
Nishiwaki et al.

(10) Patent No.: US 7,987,618 B2
(45) Date of Patent: Aug. 2, 2011

(54) SHOCK ABSORBING DEVICE FOR SHOE SOLE

(75) Inventors: Tsuyoshi Nishiwaki, Kobe (JP); Hisanori Fujita, Kobe (JP); Kiyomitsu Kurosaki, Kobe (JP)

(73) Assignee: ASICS Corporation, Kobe (JP)

( * ) Notice: Subject to any disclaimer, the term of this patent is extended or adjusted under 35 U.S.C. 154(b) by 908 days.

(21) Appl. No.: 11/918,799

(22) PCT Filed: May 13, 2005

(86) PCT No.: PCT/JP2005/008754

§ 371 (c)(1), (2), (4) Date: Oct. 18, 2007

(87) PCT Pub. No.: WO2006/120749

PCT Pub. Date: Nov. 16, 2006

(65) Prior Publication Data

US 2009/0013556 A1 Jan. 15, 2009

(51) Int. Cl.
*A43B 13/18* (2006.01)

(52) U.S. Cl. ..... 36/28; 36/25 R; 36/35 R

(58) Field of Classification Search ..... 036/28, 036/29, 25 R, 35 R, 36 R, 37, 36 A–36 C
See application file for complete search history.

(56) References Cited

U.S. PATENT DOCUMENTS

| | | | | |
|---|---|---|---|---|
| 6,568,102 | B1 | 5/2003 | Healey et al. | |
| 6,598,320 | B2 * | 7/2003 | Turner et al. | 36/28 |
| 6,694,642 | B2 * | 2/2004 | Turner | 36/28 |
| 6,722,058 | B2 * | 4/2004 | Lucas et al. | 36/28 |
| 6,931,765 | B2 * | 8/2005 | Lucas et al. | 36/35 R |
| 7,441,346 | B2 * | 10/2008 | Hardy et al. | 36/25 R |
| 7,726,042 | B2 * | 6/2010 | Meschan | 36/27 |
| 2006/0283050 | A1 * | 12/2006 | Carnes et al. | 36/132 |
| 2007/0240331 | A1 * | 10/2007 | Borel | 36/28 |
| 2009/0100705 | A1 * | 4/2009 | Cook et al. | 36/29 |
| 2009/0100709 | A1 * | 4/2009 | Macey et al. | 36/88 |
| 2010/0236096 | A1 * | 9/2010 | Pauk et al. | 36/28 |

FOREIGN PATENT DOCUMENTS

| | | |
|---|---|---|
| JP | 01-274705 | 11/1989 |
| JP | 03-26202 A | 2/1991 |
| JP | 03-85103 A | 4/1991 |

(Continued)

*Primary Examiner* — Marie Patterson
(74) *Attorney, Agent, or Firm* — Michael E. Zall

(57) ABSTRACT

A shock absorbing device for a shoe sole includes: an outer sole 2; a midsole M; and a deformation element 3 placed between the outer sole 2 and the midsole M. The deformation element 3 is positioned at a periphery of a rear foot part 1B and includes a bending deformation member 30 that opens toward the periphery from a center of the rear foot part 1B. The bending deformation member 30 includes a lower plate portion 31, an upper plate portion 32 that forms an opening angle with respect to the lower plate portion 31, and a curved portion 33 that connects the lower plate portion 31 and the upper plate portion 32. The lower plate portion 31 and the upper plate portion 32 are gradually getting away from each other as a distance from the curved portion increases. A rubber-like or pod-like compression deformation member 35 is fit between the lower and upper plate portions 31, 32. When an impact force of landing is loaded to the bending deformation member 30, the lower plate portion 31 and/or the upper plate portion 32 displaces or deflects in such a manner as to rotate about the curved portion 33 with the compression deformation member 35 being compressed.

23 Claims, 10 Drawing Sheets

FOREIGN PATENT DOCUMENTS

| | | | |
|---|---|---|---|
| JP | 03-113603 | U | 11/1991 |
| JP | 07-155206 | A | 6/1995 |
| JP | 10-257904 | A | 9/1998 |
| JP | 10-262706 | A | 10/1998 |
| JP | 2002-320502 | A | 11/2002 |

* cited by examiner

SHOCK ABSORBING DEVICE FOR SHOE SOLE

TECHNICAL FIELD

The present invention relates to a shock absorbing device for shoe sole.

BACKGROUND ART

Shoe soles require a shock absorbing function of absorbing and cushioning shocks of landing in addition to lightness in weight and a function of stably supporting the foot. Recently, some shoes have been proposed, which includes a restitution function as well as above functions. The restitution function is a function wherein the shock energy at the time of landing is stored in a shoe sole as deformation energy and the stored deformation energy is released at the time of leaving the ground. This function serves to enhance athletic ability of a wearer.

The deformation energy is stored in an element of the shoe sole by compression, bending or the like of the element. However, in general, viscoelastic materials having small Young's modulus such as resin foam, which is commonly used as a cushioning member of shoe soles, cannot exhibit high restitution function because energy is dissipated as heat etc. at the time of deformation.

The following documents disclose shoe sole structures having the above restitution function.

The first patent document: Japanese Patent Laid-Open No. 10-257904 (abstract)

The second patent document: Japanese Patent Laid-Open No. 10-262706 (abstract)

The third patent document: Japanese Patent Laid-Open No. 03-026202 (abstract)

The fourth patent document: Japanese Patent Laid-Open No. 01-274705 (abstract)

The fifth patent document: U.S. Pat. No. 6,598,320 (abstract)

The sixth patent document: U.S. Pat. No. 6,694,642 (abstract)

The seventh patent document: U.S. Pat. No. 6,568,102 (abstract)

In the shoes disclosed in Japanese Patent Laid-Open No. 10-257904 and Japanese Patent Laid-Open No. 10-262706, the entire rear foot portion is supported by a single plate spring. Thus, the support for the rear foot portion may become unstable.

In the shoes disclosed in Japanese Patent Laid-Open No. 10-257904, Japanese Patent Laid-Open No. 10-262706 and Japanese Patent Laid-Open No. 03-026202, a plate spring or a coil spring is placed in the rear foot portion. Thus, since energy is stored in these springs, high restitution function may be obtained. However, these shoes may be hard to dissipate the shock and be unable to support the foot stably.

The spring 101, disclosed in Japanese Patent Laid-Open No. 03-026202, is housed within the shoe sole. In such a structure, a part of impact energy at the time of landing is absorbed and dissipated in the sole, and the remainder of the energy is absorbed by the spring. Accordingly, the amount of energy that can be stored by the spring is reduced.

The shoe disclosed in Japanese Patent Laid-Open No. 01-274705 has a cavity which is formed in the shoe sole. A reaction plate is built in this cavity. The reaction plate has upper and lower facing sides and fore and rear curved parts that connect the upper and lower facing sides. A gel cushioning member is provided in the reaction plate.

Since the reaction plate housed in the shoe sole also in this prior art shoe, the shoe has similar demerits to the shoe of Japanese Patent Laid-Open No. 03-026202. It is supposed that the part in which deformation energy is stored due to shock of landing, is mainly the fore and rear curved parts, not the upper and lower facing sides.

In this shoe, impact load (shock force) of landing is applied to the oval spring after having been dispersed in the sole. Accordingly, since the dispersed impact load is applied on each part of the oval spring as distributed load, the amount of deflection of the endless spring is considered to be small. Therefore, impact energy cannot be stored in the oval spring sufficiently.

U.S. Pat. No. 6,598,320 and U.S. Pat. No. 6,694,642 fail to disclose a bending deformation member being generally V-shaped or U-shaped in section.

In the shoe sole disclosed in U.S. Pat. No. 6,658,102, the plate is arranged to extend over the whole of the rear foot part.

DISCLOSURE OF THE INVENTION

Therefore, an object of the present invention is to provide a shock absorbing device for a shoe sole performing a high cushioning function and a high restitution function by absorbing and storing the impact load of landing sufficiently while supporting the foot stably.

FIG. 9A shows an important part of a shock absorbing device for a shoe sole according to the present invention.

As shown in FIG. 9A, the deformation element 3, which is inserted between the outer sole and the midsole, is positioned at least partially at a periphery of a rear foot part. The deformation element 3 includes the bending deformation member 30, which opens toward the periphery from the center of the rear foot part. The bending deformation member 30 includes: the lower plate portion 31 that is joined to the upper surface of the outer sole; the upper plate portion 32 that is joined to the bottom surface of the midsole and that forms an opening angle with respect to the lower plate portion 31; and a curved portion 33 that connects the lower plate portion 31 and the upper plate portion 32, The lower plate portion 31, the upper plate portion 32 and the curved portion 33 are integrally formed of synthetic resin.

The lower and upper plate portions 31, 32 have respective opposed surfaces 51, 52 opposed to each other. The opposed surface 51 of the lower plate portion 31 and the opposed surface 52 of the upper plate portion 32 gradually get away from each other as a distance from the curved portion 33 increases. A rubber-like or pod-like compression deformation member 35 is fit between the lower and upper plate portions 31, 32, and the compression deformation member deforms so as to absorb energy and to store a force of restitution while being compressed.

In FIG. 9A, when a lopsided load is applied onto a position near the outer periphery of the upper plate portion 32, the upper plate portion 32 rotates about the curved portion 33. That is, the upper plate portion 32 deflects and displaces downward so that the upper plate portion 32 comes close to the lower plate portion 31. At this time, the compression deformation member 35 is compressed almost all of a range from the curved portion 33 to the opening. The upper and lower plate portions 32, 31 are arranged to form a taper sectional shape, i.e., the upper and lower plate portions 32, 31 are configured to gradually get away from each other as they get near to the opening. Therefore, a strain (amount of deformation per pre-deformed unit height) of the compression deformation member 35 is approximately even at almost all the range from the curved portion side to the opening side.

On the other hand, if the upper plate portion 32 and the lower plate portion 31 are parallel to each other as shown in FIG. 9G, the strain of the compression deformation member 35 differs from the curved portion side to the opening side. That is, the strain on the opening side may be far larger than the strain on the curved portion side, and it may impair the stability of the shoe.

That is, in the case of the deformation element 3 having a U-shaped sectional shape shown in FIG. 9G, since the compression deformation member 35 has an even thickness, the strain of the compression deformation member 35 is smaller at a portion near the curved portion 33 than at a portion near the opening when a lopsided load is applied onto a position near the outer periphery (for example, when the shock of the first strike is applied). On the other hand, if the compression deformation member 35 varies in vertical thickness to form a taper as shown in FIG. 9A, the strain of the compression deformation member 35 can be the same between at the portion near the curved portion 33 and at the portion near the opening when the lopsided load is applied.

If, as shown in FIG. 9G, the bending deformation member 30 has a U-shaped sectional shape, the curved portion 33 would displace in the horizontal direction when being compressed vertically. This displacement may cause a difficulty of the junction between the bending deformation member 30 and the midsole. On the other hand, if, as shown in FIG. 9A, the bending deformation member 30 has a generally V-shaped sectional shape, the lower and upper plate portions 31, 32 displace or deflect in such a manner as to rotate relative to each other about the curved portion, whereby a force of restitution is stored in the bending deformation member 30. That is, the upper and lower plate portions 32, 31 displace vertically so as to get close to each other without much displacement of the curved portion. Therefore, the bending deformation member 30 and the midsole can be easily joined to each other.

Further, since the compression deformation member 35 is formed in a taper shape, a displacement or inclination of the foot toward the periphery of the foot can be restrained, thereby increasing the stability of the support for the foot.

Further, since the upper and lower plate portions 32, 31 are arranged so as to form a taper sectional shape, it becomes easy to remove a mold or a die at the time of molding the bending deformation member.

The deformation element may be provided at a fore foot part of the foot in addition to the rear foot part.

In the present invention, by the use of the term "join", it is meant to include both direct joining and indirect joining.

The "rubber-like or pod-like compression deformation member" means a member that deforms so as to store a force of restitution (response) while being compressed, and includes not only a member having rubber elasticity such as thermoplastic elastomer and vulcanized rubber but also a pod-like or bladder-like member in which air, a gelatinous material, a soft rubber-like elastic material or the like is filled. The "thermoplastic elastomer" means a polymer material that exhibits a property of vulcanized rubber at normal temperature and gets plasticized at high temperature to be molded with a plastic processing machine.

In the present invention, the rubber-like member, i.e., the member having rubber elasticity, means a member that is capable of large deformation (for example, rupture elongation thereof is more than 100%) and that is capable of recovering its original shape after the stress σ (sigma) is removed. In this member, as shown in a solid line L1 of the stress-strain diagram of FIG. 10, generally, as the strain δ (delta) gets greater, the amount of change of the stress σ with respect to the amount of change of the strain δ becomes larger.

Accordingly, generally, as shown in a broken line L2 of the FIG. 10, a material in which, when a stress σ is above a certain extent, the strain δ increases with little increase of the stress σ (for example, resin foam) is not the member having the rubber elasticity.

As shown in FIG. 10, a proportional elastic limit $\sigma_F$ of such resin form is smaller than a proportional elastic limit $\sigma_G$ of the rubber-like member. Accordingly, such resin foam might cause unstable support of the foot when a localized load is applied.

Note that the "proportional elastic limit" means a maximum stress in the range where the relationship between the change of the compression load applied to the compression deformation member and the change of the amount of the compression of this member is proportional, i.e., where the change of the strain is proportional to the change of the compression stress.

In the present invention, the midsole supports substantially the whole of the rear foot part, and, generally, is formed of resin foam. The midsole may be formed of any material as long as the midsole can disperse the shock transferred from the deformation element, and therefore may be formed of, for example, non-foam of soft resin.

In the present invention, Young's modulus of the midsole or Young's modulus of the compression deformation member is smaller than that of the bending deformation member. Here, "Young's modulus" means a ratio of the stress to the strain in the beginning $P_I$ of the deformation of the material, as shown in FIG. 10.

According to a preferred embodiment of the present invention, the curved portion includes a hinge portion, the hinge portion being generally a center of the rotation, and the bending deformation member is generally V-shaped in section.

In a case where the bending deformation member is curved sharply at the curved portion, i.e., there is a clear hinge portion, the bending deformation member deforms so that the upper and lower plate portions rotate relatively to each other about the hinge portion when a shock load is applied to an extremity remote from the hinge portion. Therefore, the displacement of the curved portion in the horizontal direction is small.

In this case, more preferably, the lower plate portion has a first lower area being in a vicinity of the hinge portion and a second lower area being farther away from the hinge portion than the first lower area, the upper plate portion has a first upper area being in a vicinity of the hinge portion and a second upper area being farther away from the hinge portion than the first upper area, a first opening angle θ1 between the first lower area and the first upper area is larger than a second opening angle θ2 between the second lower area and the second upper area, and the second opening angle θ2 is about 5 degrees or more. The opening angles θ1, θ2 are measured in an unloaded condition.

Since the first opening angle of θ1 at the curved portion is large, the vertical distance between the upper and lower plate portions become large at a position only a little away from the center of the hinge portion. Therefore, the compression deformation member having a large thickness can be fit between the plate portions. On the other hand, since the second opening angle θ2 is set smaller, the compression deformation member is difficult to escape toward the opening when undergoing compression deformation.

The first opening angle θ1 is preferably set more than about 30 degrees, and more preferably set more than 45 degrees. The second opening angle θ2 is more preferably set at about 10 degrees to about 30 degrees.

According to a preferred embodiment of the present invention, the midsole has a first roll-up portion that rolls up from a bottom face of a foot along a side face of the foot, and the bending deformation member is provided with another roll-up portion that is formed integrally and continuously with the upper plate portion so as to roll up along the first roll-up portion.

In a case where, as shown in FIG. 9F, a roll-up portion 39 is formed integrally and continuously with the bending deformation member 30 to be continuous with the upper plate portion 32, at the time of the bending deformation, the more closer to the tip of the roll-up portion 39, the more increase the deflection of the bending deformation member 30. Therefore, the roll-up portion 39 makes it easy to support a load transferred from the midsole with the bending deformation member at the periphery of the foot.

Another shock absorbing device for a shoe sole according to the present invention, the deformation elements are positioned at the periphery of the rear foot part. The deformation element includes the bending deformation member that opens toward the periphery from the center of the rear foot part, and the bending deformation member is generally V-shaped or U-shaped in section. The bending deformation member includes: a lower plate portion that is joined to the top surface of the outer sole; an upper plate portion that is joined to the bottom surface of the midsole, and a hinge portion that connects the lower plate portion and the upper plate portion. The lower and upper plate portions and the curved portion are integrally formed of synthetic resin. A rubber-like or pod-like compression deformation member is fit between the lower and upper plate portions, and the compression deformation member deforms so as to store a force of restitution while being compressed.

The bending deformation member is provided at least at a region from one side of the medial side and the lateral side of the rear foot part to the rear end of the rear foot part. The lower plate portion is divided separately in the longitudinal direction at the region between the one side and the rear end.

If the bending deformation member is provided continuously and seamlessly from the medial or lateral side of the rear foot part up to the rear end of the rear foot part, the smooth motion where the sole of the foot gradually gets contact with the ground after the rear end of the rear foot part lands on the ground may be impossible.

On the other hand, in the bending deformation member of this shock absorbing device, the lower plate portion is divided separately. Therefore, the deformation according to the region of the foot can be easily realized and the motion of the foot during the period from the landing of the rear end of the rear foot part to the forward bending of the foot can be smoothly done.

In the present invention, the term "the bending deformation member being generally V-shaped in section" means that the cross-section of the bending deformation member along a line extending from the center toward the periphery of the rear foot part is generally V-shaped, and such-bending deformation member is configured so that the upper and lower plate portions gradually get away from each other toward the opening.

In the present invention, "the bending deformation member being generally U-shaped in section" means that the cross-section of the bending deformation member along a line extending from the center toward the periphery of the rear foot part is generally U-shaped, and such bending deformation member is configured so that the upper and lower plate portions are arranged generally parallel to each other.

In the present invention, by the use of the term "the bending deformation member being generally V-shaped or U-shaped in section" it is meant to include both "the bending deformation member being generally V-shaped in section" and "the bending deformation member being generally U-shaped in section", and also include the bending deformation member of another shape such as cup-shape, which is similar to the above shapes.

A rigidity of the curved portion, in which stress concentration easily occurs, may be larger than that of the upper plate portion and that of the lower plate portion. In this case, a thickness of the curved portion may be larger than that of the upper plate portion etc.

According to a preferred embodiment of this device, the upper plate portion is provided continuously from the one side to the rear edge.

In this embodiment, since the upper plate portion is provided continuously, the shock of landing can easily dispersed and the upper plate portion can easily be joined to the midsole.

According to a preferred embodiment of this device, a notch portion is provided in the lower plate portion of the one side, the notch portion being formed by notching a edge portion of the lower plate portion remote from the hinge portion. This notch portion may be generally U-shaped.

In this case, the notch portion enables smoother motion of the foot after landing.

According to a preferred embodiment of this device, a first reinforcing part for reinforcing an arch of the shoe sole is formed integrally with the bending deformation member.

The first reinforcing part serves to prevent the torsion of the arch.

According to a preferred embodiment of this device, a connecting member for connecting the midsole and the bending deformation member is interposed between the midsole and the bending deformation member, and the connecting member is formed in a loop shape so as to be continuous at the medial side, the rear end, the lateral side and a front end of the rear foot part.

Such connecting member having the loop shape in the rear foot part serves to prevent the torsion of the rear foot part.

In this case, it is more preferred that a second reinforcing part for reinforcing an arch of the shoe sole is formed integrally with the connecting member.

The second reinforcing part of the connecting member serves to prevent the torsion of the arch.

According to a preferred embodiment of this device, a connecting member for connecting the midsole and the bending deformation member is interposed between the midsole and the bending deformation member. Young's modulus of the material forming the connecting member is larger than that of the material forming the midsole and smaller than that of the material forming the bending deformation member.

In this case, the shock of landing is dispersed by the relatively hard bending deformation member and more dispersed by the relatively soft connecting member. Thus, the function of dispersing the shock can be enhanced, and a soft sensation on the sole of the foot can be produced.

DESCRIPTION OF THE REFERENCE NUMERALS

Figure 1A:
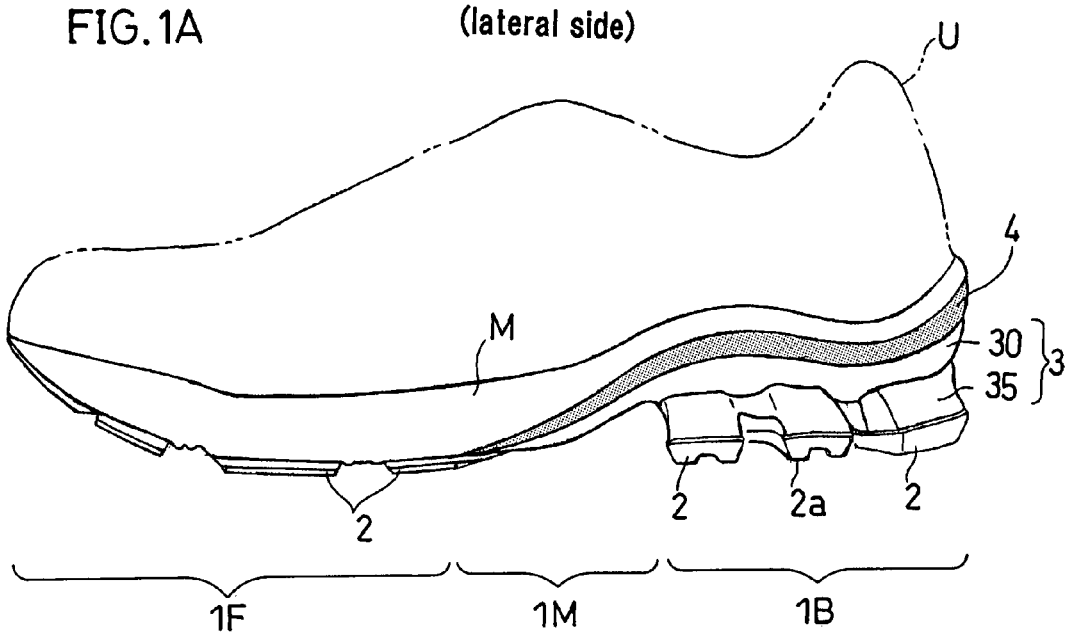
FIG. 1A is a lateral side view of a shoe according to a first embodiment and FIG. 1B is a medial side view thereof.

19: First roll-up portion
2: Outer sole
2*a*: Ground contact surface
3: Deformation element
30: Bending deformation member
31: Lower plate portion
31*a*: First lower area
31*b*: Second lower area
32: Upper plate portion
32*a*: First upper area
32*b*: Second upper area
33: Hinge portion
35: Rubber-like member (compression deformation member)
37: Notch portion
38: First reinforcing part
39: Third roll-up portion (another roll-up portion)
4: Connecting member
42: Second reinforcing part
51, 52: Opposed surface
M: Midsole
θ1: First opening angle
θ2: Second opening angle

BEST MODE FOR CARRYING OUT THE INVENTION

The present invention will be understood more apparently from the following description of preferred embodiment when taken in conjunction with the accompanying drawings. However, it will be appreciated that the embodiments and the drawings are given for the purpose of mere illustration and explanation and should not be utilized to define the scope of the present invention. The scope of the present invention is to be defined only by the appended claims. In the drawings annexed, the same reference numerals denote the same or corresponding parts throughout several views.

Hereinafter, embodiments of the invention will be described with reference to the drawings.

First Embodiment

FIGS. 1 to 8 show the first embodiment.

Figure 1B:
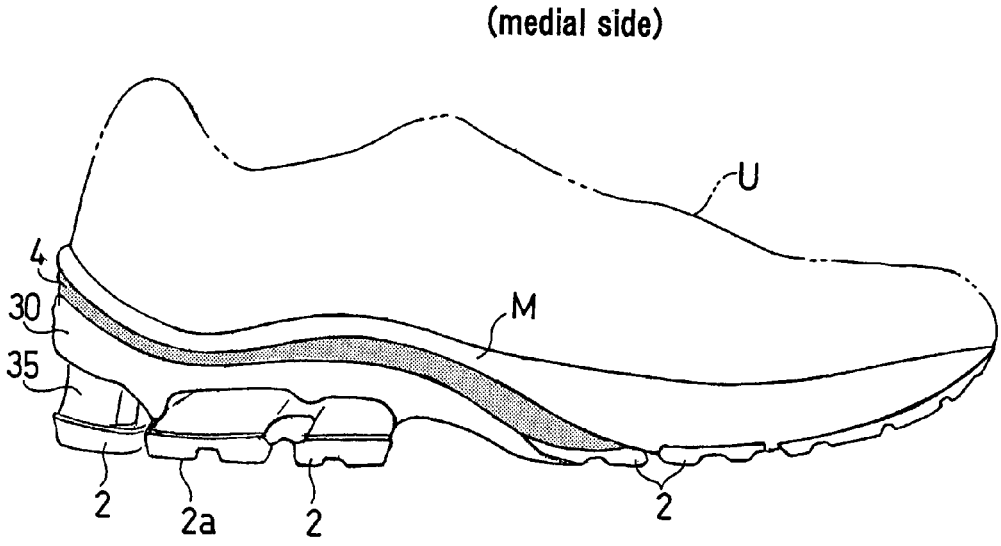

FIG. 1A shows a lateral side of the shoe (for a left foot) of the first embodiment and FIG. 1B shows a medial side of the same shoe.

As shown in FIGS. 1A, 1B, the shoe sole of this embodiment includes an midsole M, an outer sole 2, a deformation element 3 and a connecting member 4. The deformation element 3 consists of a bending deformation member 30 and rubber-like members 35 (an example of a compression deformation member).

The outer sole 2 is joined to the bottom surface of the midsole M in the fore foot part (toe part) 1F. The connecting member 4 is joined to the bottom surface of the midsole M in an area extending from the mid foot part (arch part) 1M and the rear foot part (heel part) 1B. The upper surface of the bending deformation member 30 is joined to the bottom surface of the connecting member 4, and the rubber-like members 35 are arranged to be sandwiched between portions of the bending deformation member 30. The outer sole 2 is joined to the bottom surface of the bending deformation member 30. An insole (not shown) is adhesive bonded onto the midsole.

In FIGS. 1A, 1B, the connecting member 4 is dot-meshed in order to understand easily the relationship among the members.

The midsole M is, for example, formed of a material suitable for shock absorption, such as resin foam of EVA (ethylene-vinyl acetate copolymer), polyurethane or the like. Above the midsole M and the insole, the upper U suitable for covering the instep of the foot is disposed, as shown by two-dot chain line in FIGS. 1A, 1B. The outer sole 2 is made of a material having higher abrasion resistance than the midsole M and has a ground contact surface 2*a* that contacts the ground surface or the floor surface at landing.

The connecting member 4 and the bending deformation member 30 are sandwiched between the outer sole 2 and the midsole M at the front end of the mid foot part 1M.

Figure 2:
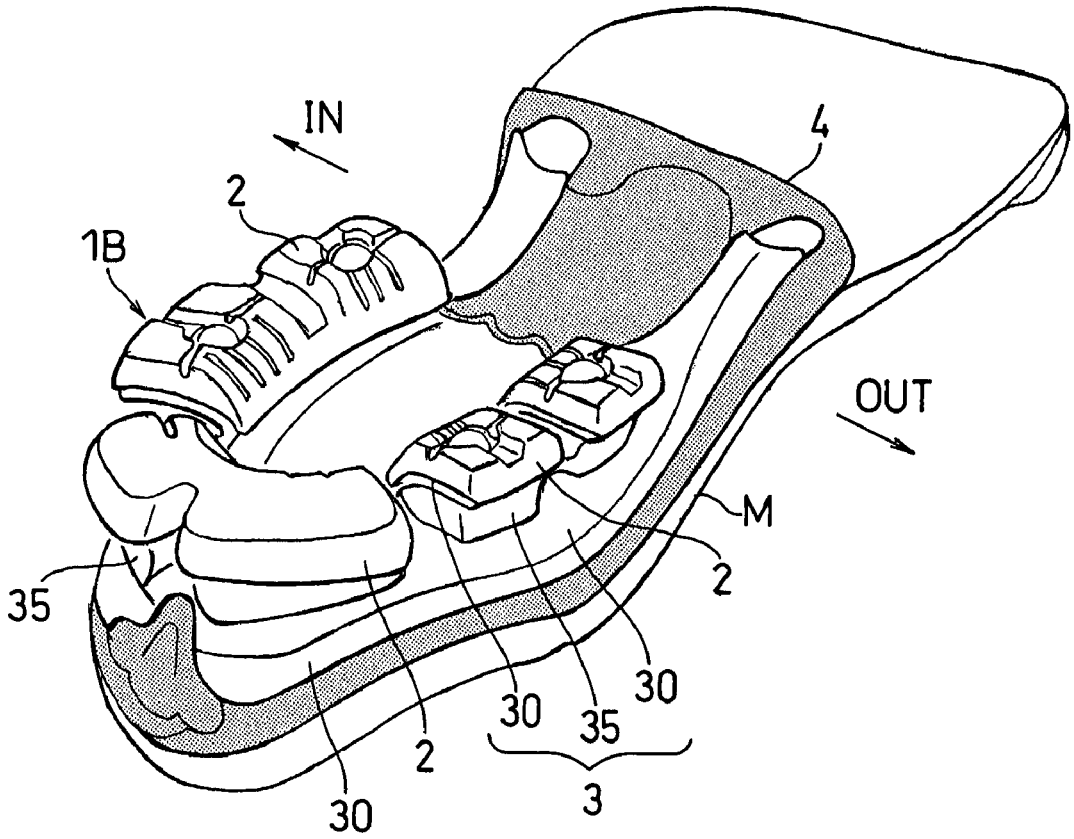
FIG. 2 is a perspective view of the shoe sole viewed from the bottom side.

In FIG. 2, the illustration of the outer sole of the fore foot part is omitted. In the figures, the arrow IN indicates the direction toward the medial side of the foot, and the arrow OUT indicates the direction toward the lateral side of the foot.

As shown in FIG. 2, the outer sole 2 is arranged along the periphery of the rear foot part 1B and is divided into three. The three divided outer soles 2 are disposed on the lateral side of the rear foot part 1B, the medial side of the rear foot part 1B and the rear end of the rear foot part, respectively, and they are spaced apart from each other.

Figure 3:
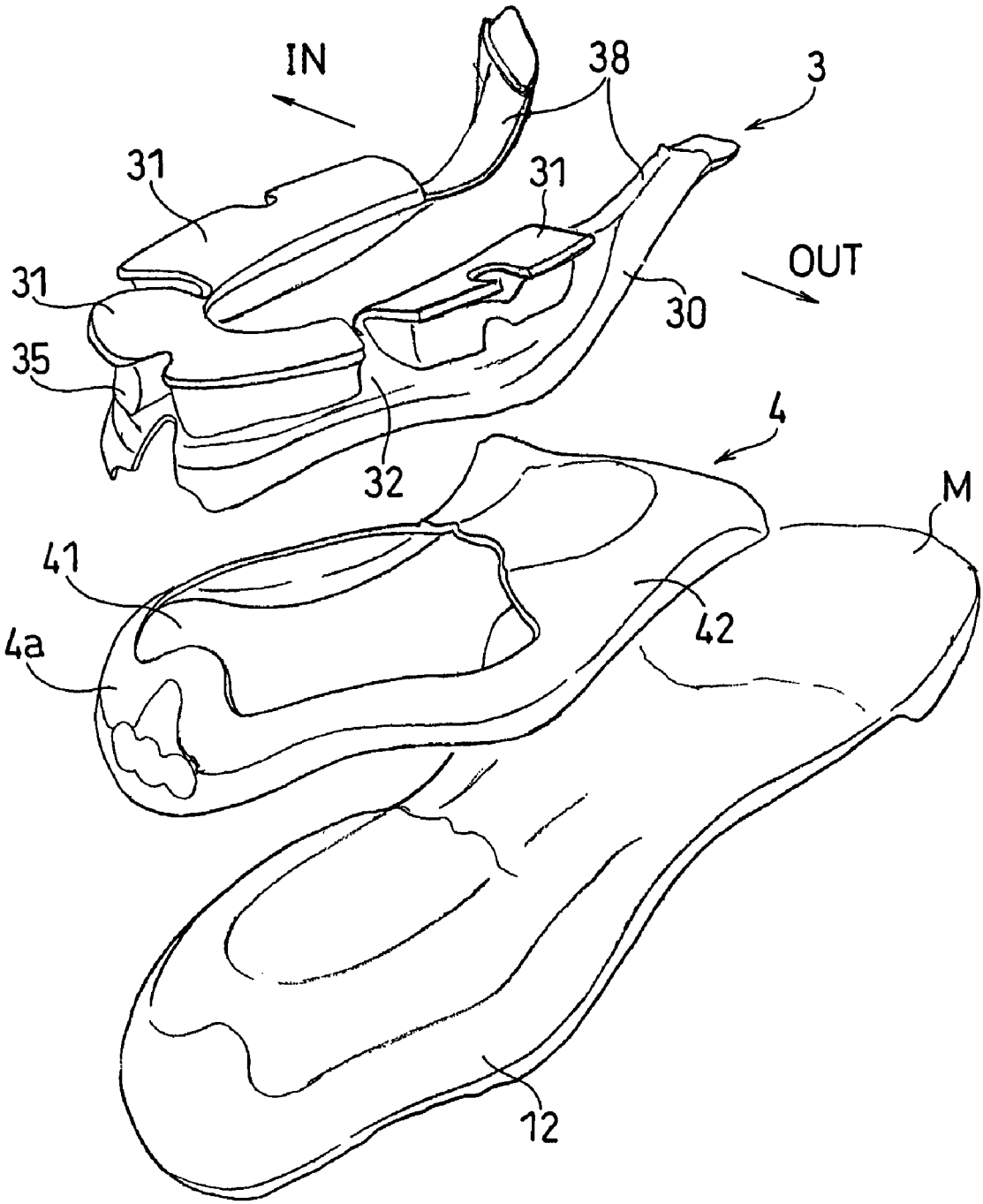
FIG. 3 is an exploded perspective view of the shoe sole viewed from the bottom side.

As shown in FIG. 3, the bending deformation member 30 above the outer sole 2 is arranged along the periphery of the foot in the area extending from the mid foot part 1M (FIG. 1A) and the rear foot part 1B (FIG. 1A). The connecting member 4 above the bending deformation member 30 is arranged along the periphery of the foot in the area extending from the mid foot part and the rear foot part and covers substantially the whole of the mid foot part of the midsole M.

Figure 4:
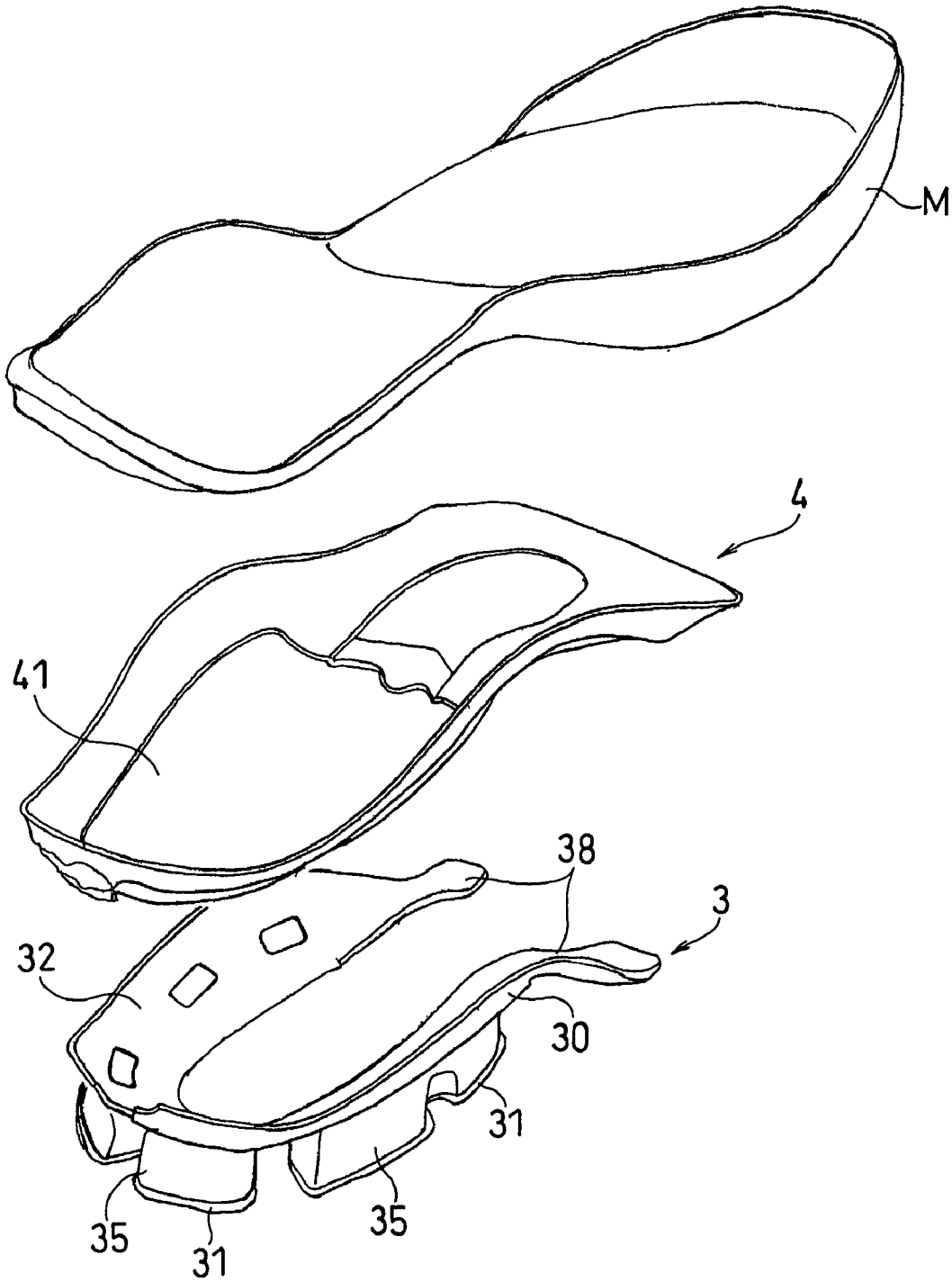
FIG. 4 is an exploded perspective view of the shoe sole viewed from the upper side.

FIGS. 3, 4 are exploded perspective views of the deformation element 3, the connecting member 4 and the midsole M. FIG. 3 is a view from the bottom side and FIG. 4 is a view from the upper side.

As shown in FIG. 3, the bending deformation member 30 of the deformation element 3 is generally horseshoe-shaped (similar to the U-shape) in a plan view and extends from the medial side IN of the mid foot part to the lateral side OUT of the mid foot part through the medial side IN, the rear end, and the lateral side OUT of the rear foot part. A portion of the bending deformation member 30 in the mid foot part constitutes a first reinforcing part 38 for restraining the torsion of the arch. In the rear foot part, the bending deformation member 30 includes a lower plate portion 31 disposed on the outer sole side and an upper plate portion 32 disposed on the midsole side. The rubber-like members 35 are fit between the lower and upper plate portions 31, 32. This bending deformation member 30 is joined to a joining face 4*a* provided on the bottom surface of the connecting member 4 and joined to the bottom surface of the midsole M.

The connecting member 4 interposed between the deformation element 3 and the midsole M extends from the mid foot part to the rear foot part. In the rear foot part, the connecting member 4 is formed in a loop shape so as to extend over the medial side IN, the rear end and the lateral side OUT of the rear foot part. An opening 41 is provided in the connecting member 4 at the central portion of the rear foot part. In the mid foot part, the connecting member 4 covers substantially the whole of the midsole M and constitutes a second reinforcing part 42 for restraining the torsion of the arch of the shoe. The connecting member 4 is joined to a joining face 12 provided on the bottom surface of the midsole M.

At the central portion of the mid foot part, the connecting member 4 and the midsole M are not joined to each other. That is, at the central portion of the mid foot part, the connecting member 4 and the midsole M are vertically spaced from each other. Since the opening 41 is provided in the connecting member 4, the bottom surface of the midsole M at the central portion of the rear foot part is exposed without being covered by the connecting member 4 nor the deformation element 3 (FIG. 2). Such constitution enables the midsole M to sink down at the central portion of the rear foot part, thereby improving the cushioning property.

Figure 5A:
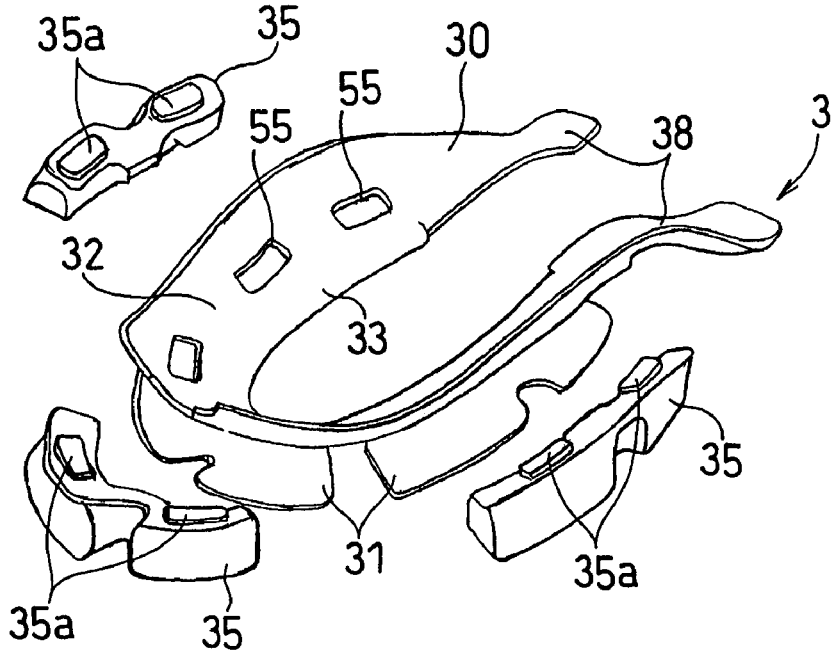
FIG. 5A is an exploded perspective view of a bending deformation member and rubber-like members viewed from the upper side and FIG. 5B is an exploded perspective view thereof viewed from the bottom side.
Figure 5B:
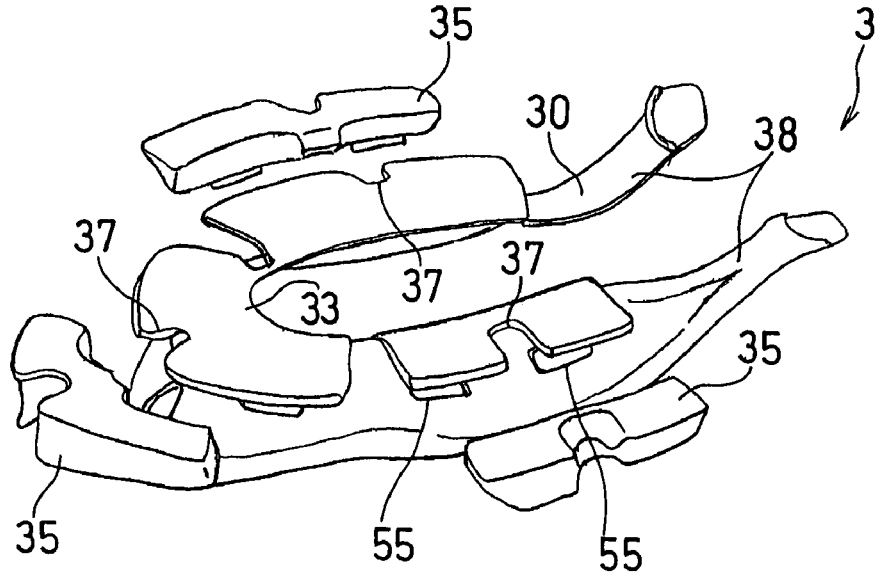

Deformation Element:

As shown in FIGS. 5A, 5B, the deformation element 3 includes one bending deformation member 30 and three rubber-like members 35. The bending deformation member 30 includes: the upper plate portion 32 indirectly joined to the bottom surface of the midsole M via the connecting member 4; the lower plate portion 31 joined to the upper surface of the outer sole 2; and a hinge portion 33 (an example of an curved portion) connecting the upper and lower portions 32, 31. The upper and lower plate portions 32, 31 and the hinge portion 33 are integrally formed with each other from synthetic resin.

As shown in FIG. 5A, the upper plate portion 32 is provided continuously along the periphery of the rear foot portion and connected to the first reinforcing part 38 of the mid foot part. The rear end portion of the upper plate portion 32 is partially notched (FIG. 3). A plurality of generally square-shaped through holes 55 are provided in the upper plate portion 32.

As shown in FIG. 5B, the lower plate portion 31 is provided along the periphery of the rear foot part. The lower plate portion 31 is divided longitudinally at a position between the rear end and the medial side of the rear foot part and at a position between the rear end and the lateral side of the rear foot part. Thus, the lower plate portion 31 is divided into three separated regions: the medial side region of the rear foot part; the rear end region of the rear foot part; and the lateral side region of the rear foot part. Each region of the lower plate portion 31 has a generally U-shaped notch 37 at an extremity remote from the hinge portion 33.

Figure 6A:
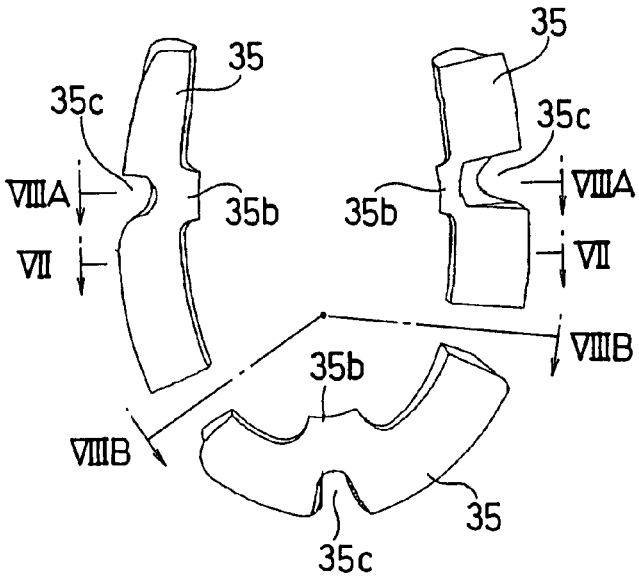
FIG. 6A is a bottom plan view of the rubber-like members according to this embodiment and FIG. 6B and FIG. 6C each is a bottom plan view of the rubber-like members according to modified embodiments.

Three rubber-like members 35 are each sandwiched between the upper and lower plate portions 32, 31 and adhesive-joined to the upper and lower plate portions 32, 31. As shown in FIG. 6A, the rubber-like member 35 has a planar shape corresponding to that of the respective region of the lower plate portion 31, and has a notch 35*c* at a position corresponding to the notch 37 of the lower plate portion 31.

As shown in FIG. 5A, upper protrusions 35*a* protruding upwards are provided on the upper surface of the rubber-like member 35. These upper protrusions 35*a* are fit into and engaged with the through holes 55 of the upper plate portion 32. Thus, when the deformation element 3 is vertically compressed in a bonding process of manufacturing the deformation element, the rubber-like members 35 can be supported stably between the upper and lower plate portions 32, 31. In order to support the rubber-like members 35 more stably between the upper and lower plate portions 32, 31, the upper plate portion 32 and/or the lower plate portion 31 may have a through hole and/or a protrusion.

Thus, the lower plate portion 31 is divided into three regions spaced apart from each other and the three rubber-like members 35 are arranged in accordance with the three regions. It facilitates the deformation of the shoe sole in accordance with the regions of the rear foot part and so enables smooth motion of the foot during the period from the landing of the rear end of the rear foot part to the forward bending of the foot. Furthermore, the notches 37 of the lower plate portion 31 and the notches 35*c* of the rubber-like members 35 enable more smooth motion of the foot.

Young's modulus of a material forming the bending deformation element 30 is larger than that of a material forming the midsole M and larger than that of a material forming the outer sole 2. Furthermore, the Young's modulus of the material forming the bending deformation member 30 is preferably set larger than Young's modulus of a material forming the connecting member 4, and the Young's modulus of the material forming the connecting member 4 is preferably set larger than the Young's modulus of the material forming the midsole M. Such settings make the shock of landing dispersed by the relatively hard bending deformation member 30 and more dispersed by the connecting member 4, thereby producing a soft sensation on the sole of the foot.

In view of the cushioning property and the stability, the Young's modulus of the rubber-like member 35 (coefficient of elasticity within the proportional elastic limit) is preferably set at 0.1 kgf/mm$^2$ to 5.0 kgf/mm$^2$, more preferably set at 0.3 kgf/mm$^2$ to 3.0 kgf/mm$^2$, and most preferably set at 0.3 kgf/mm$^2$ to 2.0 kgf/mm$^2$. In this case, the Young's modulus of the bending deformation member 30 is preferably set at 1.0 kgf/mm$^2$ to 30 kgf/mm$^2$, more preferably set at 2.0 kgf/mm$^2$ to 15 kgf/mm$^2$, and most preferably set at 3.0 kgf/mm$^2$ to 10 kg/mm$^2$.

The rubber-like member 35 may be formed of rubber or rubber-like synthetic resin (thermoplastic elastomer), for example. In the case where the rubber-like member is formed of rubber-like synthetic resin, for example, gel (commercial name for the cushioning member), a material of the rubber-like member 35 may be, for example, polyurethane gel or styrene gel, which can improve the adhesion between the rubber-like member 35 and the bending deformation member 30.

The material of the bending deformation member 30 may be, for example, non-foam resin such as nylon, polyurethane and FRP. Instead of the rubber-like member 35, a member that deforms so as to store a force of restitution (response) while being compressed, such as a pod-like member in which air, liquid or the like is filled, may be used.

Figure 7:
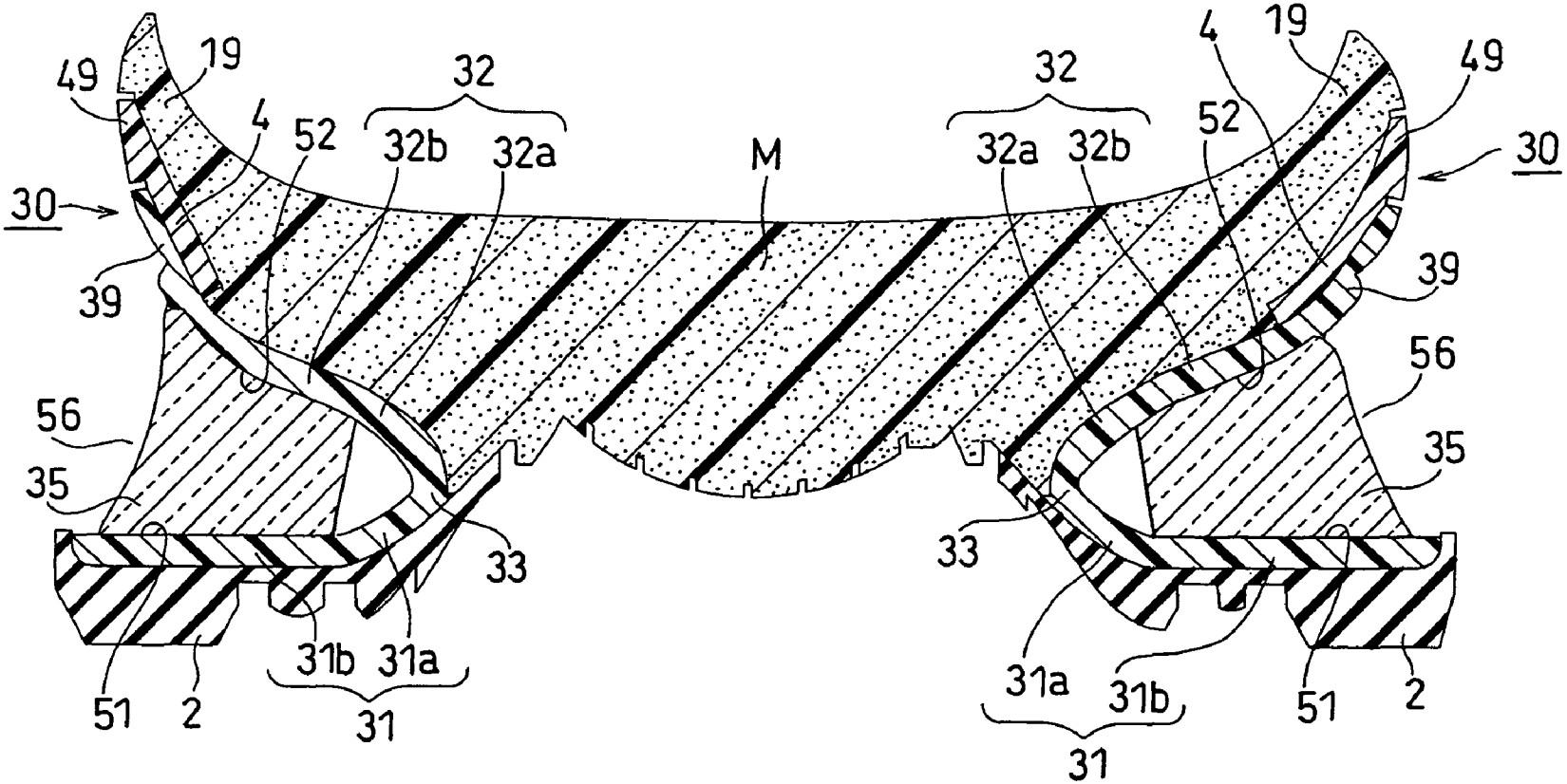
FIG. 7 is a sectional view of the shoe sole taken along the line VII-VII of FIG. 6A.
Figure 8A:
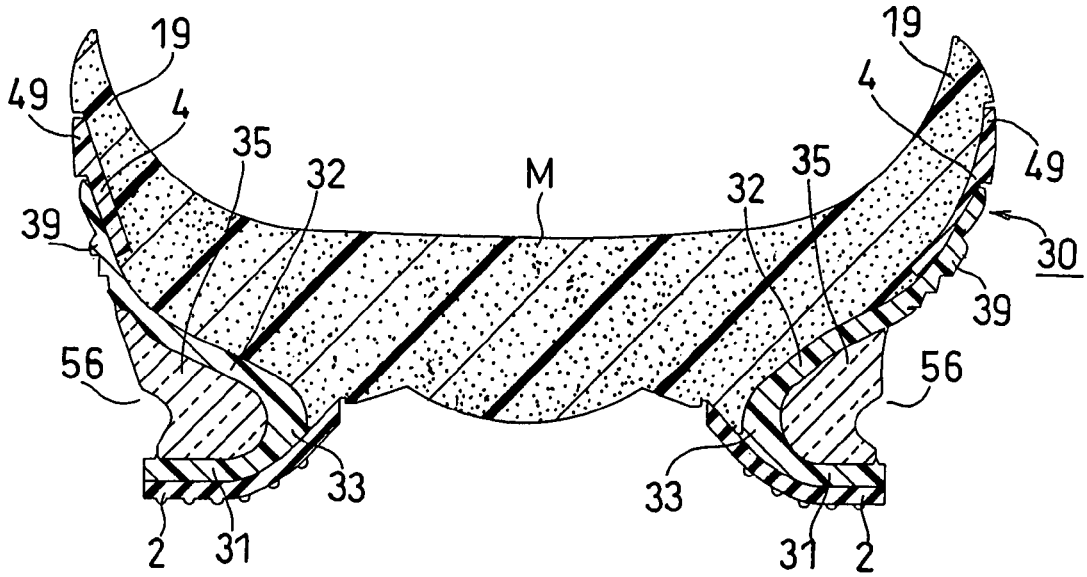
FIG. 8A is a sectional view of the shoe sole taken along the line VIIIA-VIIIA of FIG. 6A.

Sectional Shape of the Deformation Element:

In this embodiment, as shown in FIGS. 7, 8A, the bending deformation member 30 has a generally V-shaped cross section in an region where the rubber-like member 35 is provided and opens toward the periphery of the rear foot part thereby forming an opening 56. That is, the upper and lower plate portions 32, 31 have respective opposed surfaces 52, 51 opposed to each other, the opposed surface 52 of the upper plate portion 32 and the opposed surface 51 of the lower plate portion 31 gradually getting away from each other as the distance from the hinge portion 33 increases, i.e., as it goes from the hinge portion 33 toward the opening 56.

The lower plate portion 31 has a first lower area 31*a* being in the vicinity of the hinge portion 33 and a second lower area 31*b* being nearer to the opening 56 than the first lower area 31*a*, and the rubber like member 35 is in contact with the second lower area. The upper plate portion 32 has a first upper area 32*a* being in the vicinity of the hinge portion 33 and a second upper area 32*b* being in the vicinity of the opening 56, and the rubber like member 35 is in contact with the second upper area.

Figure 9A:
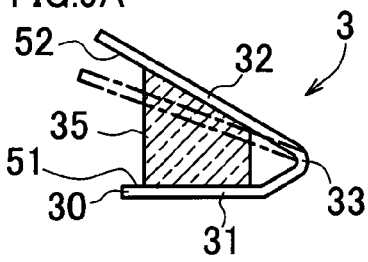
FIG. 9A to FIG. 9G each are schematic sectional view showing example of the bending deformation member.
Figure 9B:
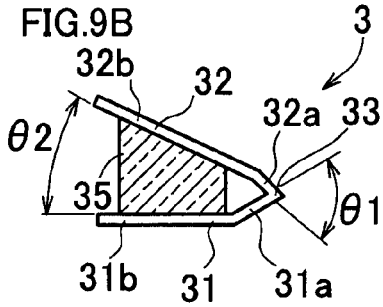

As shown in FIG. 9B, an angle (first opening angle) θ1 between the first upper area 32*a* and the first lower area 31*a* is larger than an angle (second opening angle) θ2 between the second upper area 32*b* and the second lower area 31*b*. That is, the angle between the upper and lower plate portions 32, 31 is set larger in the vicinity of the hinge portion 33 and smaller in the vicinity of the opening 56.

The first opening angle θ1 in an unloaded condition is preferably set at about 30 degrees to about 120 degrees, more preferably set at about 50 degrees to about 100 degrees, and most preferably set at about 60 degrees to about 90 degrees. An average of the second opening angle θ2 in an unloaded condition is preferably set at about 5 degrees to about 60 degrees, more preferably set at about 10 degrees to about 50 degrees, and most preferably set at about 15 degrees to about 45 degrees.

In this embodiment, the second lower area 31*b* is configured to be generally parallel to the ground surface. However, the second lower area 31*b* need not necessarily be arranged in such a configuration, and may be configured to be inclined upwards or downwards from the center toward the periphery of the rear foot part.

Figure 8B:
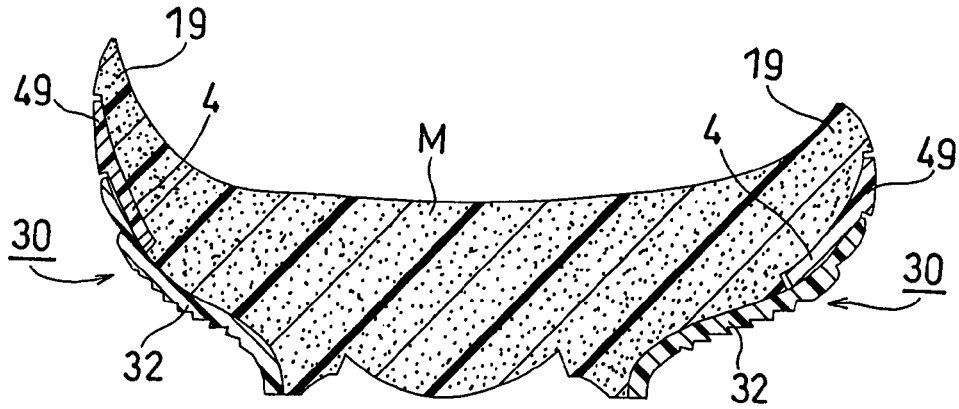
FIG. 8B is a sectional view of the shoe sole taken along the line VIIIB-VIIIB of FIG. 6A.

As shown in FIGS. 7, 8A, 8B, a first roll-up portion 19 is integrally formed with the midsole M at the periphery of the rear foot part so as to be rolling upwards along the side face from the bottom face of the foot. Outside the first roll-up portion 19, a second roll-up portion 49 is arranged to extend along the first roll-up portion 19. In addition, outside the second roll-up portion 49, a third roll-up portion (an example of another roll-up portion) 39, which is formed continuously from the upper plate portion 32 of the bending deformation member 30, is arranged to extend along the first roll-up portion 19. The first to third roll-up portions 19, 49, 39 enable the bending deformation member 30 to support easily a load transferred from the midsole M at the periphery of the rear foot part.

As shown in FIG. 7, the rubber-like member 35 is of such a shape that a vertical thickness thereof gradually becomes larger moving away from the hinge portion 33 between the upper and lower plate portions 32, 31 so as to be in conformity with the sectional shape of the bending deformation member 30. The rubber-like member 35 is arranged in close contact with the surfaces (the opposed surfaces 52, 51) of the upper and lower plate portions 32, 31.

Since, as above-mentioned, the angle between the upper and lower plate portions 32, 31 is larger in the vicinity of the hinge portion 33 and smaller in the vicinity of the opening 56, the midsole M does not become thin at the center of the rear foot portion. Therefore, the rubber-like member 35 having a relatively large thickness can be disposed, thereby obtaining an improved cushioning property.

A side surface of the rubber-like member 35 facing the opening 56 is configured to be slightly concave at vertically central portion. The reason is that such configuration makes the rubber-like member 35 easily deform when being compressed. This side surface need not necessarily be concave, and may be configured as shown in FIG. 9B.

As shown in FIGS. 5A, 5B, 6A, the rubber-like member 35 is concave in conformity with the U-shaped notch 37 at a position corresponding to the notch 37 of the lower plate portion 31, and has a inner protrusion 35*b* protruding toward the center of the rear foot part. Therefore, as shown in the sectional view of FIG. 8A, at the position corresponding to the notch 37, the rubber-like member 35 fit into the bending deformation member 30 up to the hinge portion 33 without clearance so as to be in close contact with the surface of the bending deformation member 30. Such close contact makes the rubber-like member 35 held stably between the upper and lower plate portions 32, 31. On the other hand, as shown in the sectional view of FIG. 7, at the other position, there is a gap between the rubber-like member 35 and the hinge portion 33. Such a gap enables the rubber-like member 35 to escape toward the center of the rear foot part when being compressed, and so the rubber-like member 35 can easily deform.

Figure 6B:
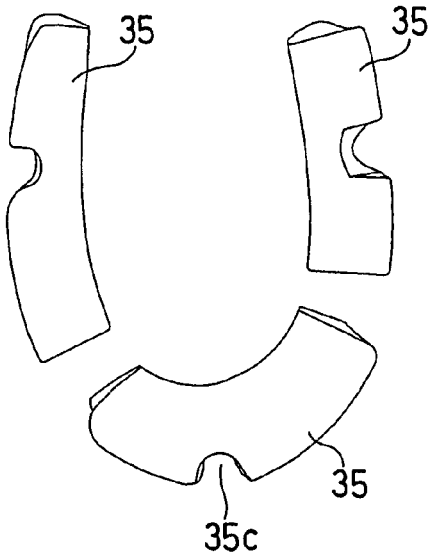

The shape of the rubber-like member 35 is not limited to the shape shown in FIG. 6A, and other shapes may be applied. For example, as shown in FIG. 6B, the rubber-like member 35 may be configured without inner protrusion which is protruding toward the center of the rear foot part, i.e., the shape of the inner side of the rubber-like member 35 may be configured to be along the hinge portion 33 of the bending deformation member 30. In this case, at almost all the positions, the rubber-like member 35 fit into the hinge portion 33 without clearance to be in close contact. Therefore, the rubber-like member 35 can be supported stably. And since there is no gap between the hinge portion 33 and the rubber-like member 35, foreign matters or the like can be prevented form entering into the deformation element and the bending deformation member can be prevented to being damaged due to such foreign matters.

Figure 6C:
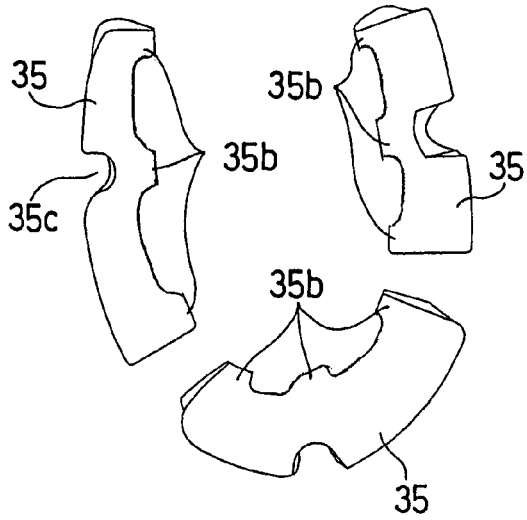

As shown in FIG. 6C, the rubber-like member 35 may include three inner protrusions 35*b* protruding toward the center of the rear foot part. In this case, since the inner protrusions 35*b* are provided at both end portions and the central portion, the gap between the rubber-like member 35 and the hinge portion 33 is closed. Therefore, the entrance of foreign matters into the gap can be prevented while the deformability of the rubber-like member 33 is kept high.

The bending deformation member 30 has, preferably, a generally V-shaped or trapezoidal cross-section like this embodiment, but may have another shape of cross-section. Further, various shapes may be applied to the cross-section of the rubber-like member 35, in view of the bending property or the prevention of the entrance of foreign matters into the gap. Such various shapes of the deformation element 3 are shown in FIGS. 9A to 9F, for example.

For example, as shown in FIG. 9A, the upper plate portion 32 may be formed generally flat without the first and second upper areas inclined differently from each other. Even in this case, as shown by one-dot chain line of FIG. 9A, the upper and lower plate portion 32, 31 can rotate relative to each other.

Figure 9C:
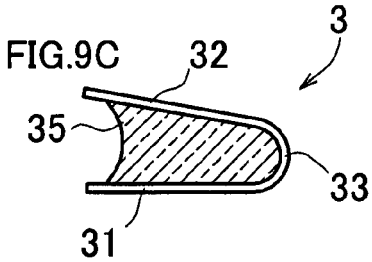
Figure 9D:
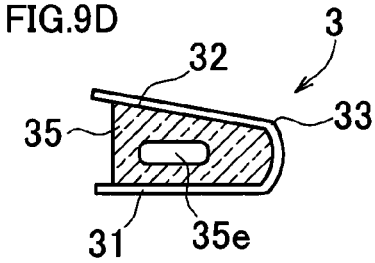

As shown in FIGS. 9C, 9D, the bending deformation member 30 may be configured so that the hinge portion 33 has a substantially smooth arc sectional shape and that the upper and lower plate portions 32, 31, which are formed generally flat, gradually get away from each other as a distance from the hinge portion 33 increases. In these figures, the rubber-like member 35 is interposed to extend up to the hinge portion 33 without clearance.

Figure 9E:
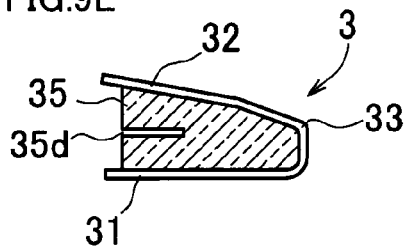
Figure 9F:
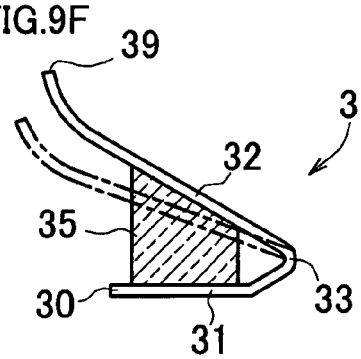

As shown in FIGS. 9D, 9E, the rubber-like member 35 may have a hollow portion 35*e* or a slit 35*d*. Corner portions of the rubber-like member 35 may be rounded so that shearing deformation occurs therein.

Figure 9G:
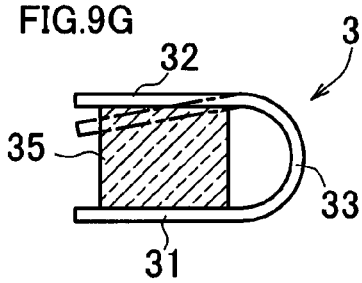
Figure 10:
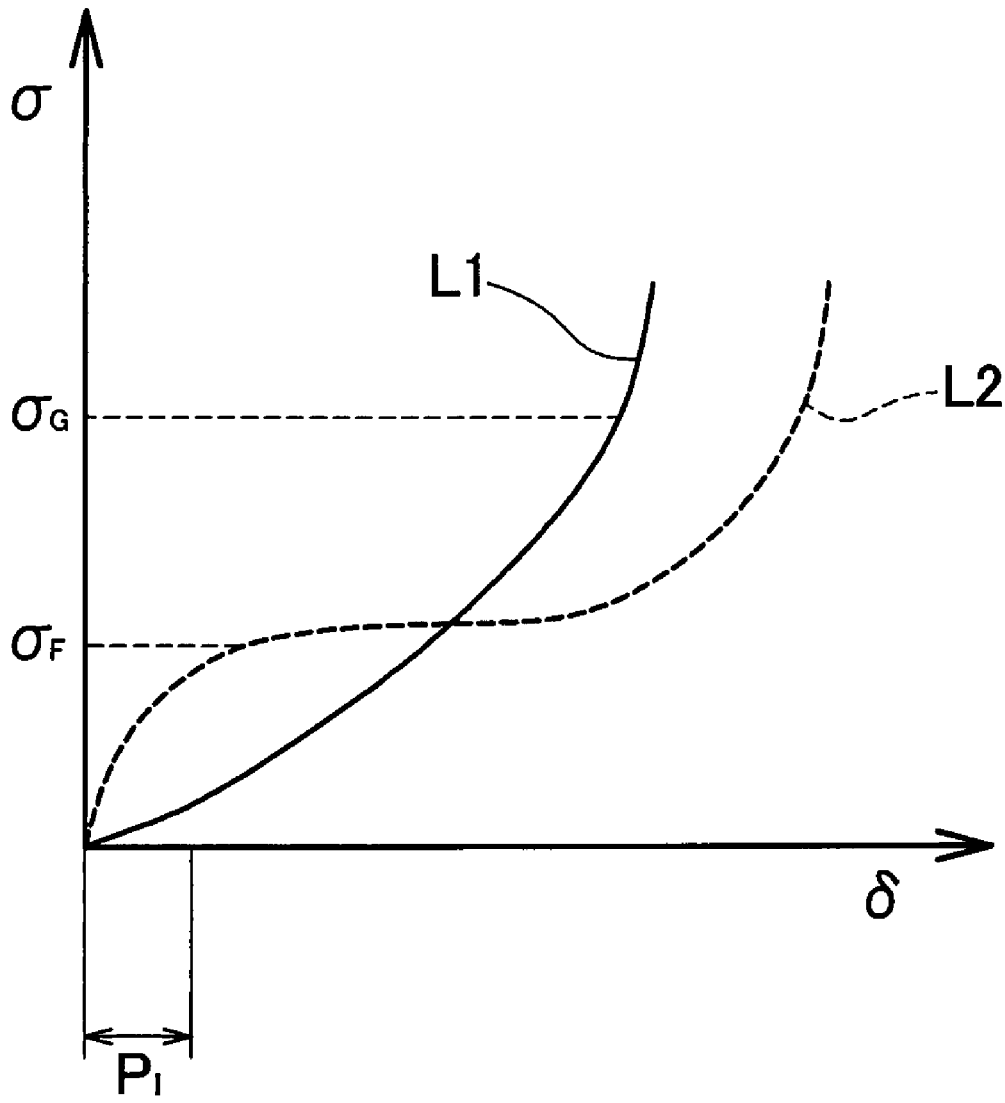
FIG. 10 is a stress-strain diagram.

As shown in FIG. 9G, the bending deformation member 30 may have a generally U-shaped sectional shape, i.e., the upper and lower plate portions 32, 31 may be generally parallel to each other.

While preferred embodiments of the present invention have been described above with reference to the drawings, obvious variations and modifications will readily occur to those skilled in the art upon reading the present specification.

For example, the bending deformation member may be directly joined to the midsole without the connecting member. Another member may be interposed between the bending deformation member and the outer sole. The midsole may be divided vertically or longitudinally.

The deformation elements may be disposed only one of the medial and lateral side. The deformation element may be provided at the fore foot part in addition to the rear foot part. The notch of the deformation elements need not necessarily be provided.

The number of the rubber-like members is not limited to the above embodiment, and four or more separate lower plate portions and four or more separate rubber-like members may be provided in the rear foot part.

The through holes of the upper plate portion and the upper protrusions of the rubber-like member need not necessarily be provided, and the rubber-like member may be supported merely by being sandwiched by the bending deformation member.

Thus, such variations and modifications shall fall within the scope of the present invention as defined by the appended claims.

INDUSTRIAL APPLICABILITY

The present invention is applicable to shoe soles of various shoes such as athletic shoes.

The invention claimed is:

1. A shock absorbing device for a shoe sole comprising: an outer sole having a ground contact surface that contacts a ground and an upper surface opposite to the ground contact surface;

a midsole having a bottom surface, the midsole placed above the outer sole; and a deformation element placed between the outer sole and the midsole, wherein the deformation element is positioned at least partially at a periphery of a rear foot part, the deformation element includes an integrally formed and continuous bending deformation member that opens toward the periphery from a center of the rear foot part, Young's modulus of a material forming the bending deformation member is larger than that of a material forming the midsole and that of a material forming the outer sole, the bending deformation member comprises a lower plate portion that is joined to the upper surface of the outer sole, an upper plate portion that is joined to the bottom surface of the midsole and that forms a predetermined opening angle with respect to the lower plate portion, and a curved portion that connects the lower plate portion and the upper plate portion, wherein the lower plate portion, the upper plate portion and the curved portion are integrally formed and continuous with each other and produced from a non-foam synthetic resin, the curved portion of the bending deformation member extends along at least a medial periphery, a rear end periphery, or a lateral periphery of the rear foot part, and the lower and upper plate portions have respective opposed surfaces opposed to each other, the opposed surface of the lower plate portion and the opposed surface of the upper plate portion gradually getting away from each other as a distance from the curved portion increases, a compression deformation member is fit between the lower and upper plate portions, the compression deformation member deforming so as to store a force of restitution while being compressed, the compression deformation member gradually increases in thickness as the distance from the curved portion increases, and when an impact force of landing is loaded to the bending deformation member, the lower plate portion and/or the upper plate portion displaces or deflects in such a manner as to rotate about the curved portion with the compression deformation member being compressed so that the opening angle decreases, whereby a force of restitution is stored in the bending deformation member.

2. A shock absorbing device for a shoe sole according to claim 1, wherein the curved portion includes a hinge portion, the hinge portion being generally a center of the rotation of the lower plate portion and/or the upper plate portion, and the bending deformation member is generally V-shaped in section.

3. A shock absorbing device for a shoe sole according to claim 2, wherein the lower plate portion has a first-lower area being in a vicinity of the hinge portion and a second lower area being farther away from the hinge portion than the first lower area, the upper plate portion has a first upper area being in a vicinity of the hinge portion a second upper area being farther away from the hinge portion than the first upper area, and a first opening-angle between the first lower area and the first upper area is larger than a second opening angle between the second lower area and the second upper area, the second opening angle being about 5 degrees or more.

4. A shock absorbing device for a shoe sole according to claim 3, wherein the first opening angle is about 30 degrees or more.

5. A shock absorbing device for a shoe sole according to claim 1, wherein the midsole has a first roll-up portion that rolls up from a bottom face of a foot along a side face of the foot, and the bending deformation member is provided with another roll-up portion that is formed integrally and continuously with the upper plate portion so as to roll up along the first roll-up portion.

6. A shock absorbing device for a shoe sole according to claim 1, wherein the curved portion of deformation element is provided at least at one of a medial side of the rear foot part, a lateral side of the rear foot part and a rear end of the rear foot part.

7. A shock absorbing device for a shoe sole according to claim 1, wherein the compression deformation member is a compression member having a Young's modulus about 0.1 $kgf/mm^2$ to about 5.0 $kgf/mm^2$.

8. A shock absorbing device for a shoe sole according to claim 7, wherein Young's modulus of the material forming the bending deformation member is about 1.0 kgf/mm$^2$ to about 30 kgf/mm$^2$.

9. A shock absorbing device for a shoe sole according to claim 1, wherein a protruding portion is provided on an upper surface or a lower surface of the compression deformation member, and a through hole with which the protruding portion is engaged is provided in the bending deformation member.

10. A shock absorbing device for a shoe sole comprising: an outer sole having a ground contact surface that contacts a ground and an upper surface opposite to the ground contact surface; a midsole having a bottom surface, the midsole placed above the outer sole; and a deformation element placed between the outer sole and the midsole, wherein the deformation element is positioned at least partially at a periphery of a rear foot part, the deformation element includes an integrally formed and continuous bending deformation member that opens toward the periphery from a center of the rear foot part, the bending deformation member being generally V-shaped or U-shaped in section, Young's modulus of a material forming the bending deformation member is larger than that of a material forming the midsole and that of a material forming the outer sole, the bending deformation member comprises a lower plate portion that is joined to the upper surface of the outer sole, an upper plate portion that is joined to the bottom surface of the midsole, and a curved portion that connects the lower plate portion and the upper plate portion, wherein the lower plate portion, the upper plate portion and the curved portion are integrally formed and continuous with each other and produced from a non-foam synthetic resin, a compression deformation member is fit between the lower and upper plate portions, the compression deformation member deforming so as to store a force of restitution while being compressed, the bending deformation member is provided at least at a region from one side of a medial side and a lateral side of the rear foot part to a rear end of the rear foot part, the curved portion of the bending deformation member extends along at least a medial periphery, a rear end periphery, or a lateral periphery of the rear foot part, and the lower plate portion is separated in a longitudinal direction at the region between the one side and the rear end.

11. A shock absorbing device for a shoe sole according to claim 10, wherein the upper plate portion is provided continuously from the one side to the rear end.

12. A shock absorbing device for a shoe sole according to claim 10, wherein a notch portion is provided in the lower plate portion of the one side, the notch portion being formed by notching a edge portion of the lower plate portion remote from the curved portion.

13. A shock absorbing device for a shoe sole according to claim 10, wherein a first reinforcing part for reinforcing an arch of the shoe sole is formed integrally with the bending deformation member.

14. A shock absorbing device for a shoe sole according to claim 10, wherein a connecting member for connecting the midsole and the bending deformation member is interposed between the midsole and the bending deformation member, and the connecting member is formed in a loop shape so as to be continuous at the medial side, the rear end, the lateral side and a front end of the rear foot part.

15. A shock absorbing device for a shoe sole according to claim 14, wherein a second reinforcing part for reinforcing an arch of the shoe sole is formed integrally with the connecting member.

16. A shock absorbing device for a shoe sole according to claim 10, wherein a connecting member for connecting the midsole and the bending deformation member is interposed between the midsole and the bending deformation member, and Young's modulus of a material forming the connecting member is larger than that of the material forming the midsole and smaller than that of the material forming the bending deformation member.

17. A shock absorbing device for a shoe sole according to claim 10, wherein a protruding portion is provided on an upper surface or a lower surface of the compression deformation member, and a through hole with which the protruding portion is engaged is provided in the bending deformation member.

18. A shock absorbing device for a shoe sole comprising: an outer sole having a ground contact surface that contacts a ground and an upper surface opposite to the ground contact surface; a midsole having a bottom surface, the midsole placed above the outer sole; and a deformation element placed between the outer sole and the midsole, wherein the deformation element is positioned at least partially at a periphery of a rear foot part, the deformation element includes an integrally formed and continuous bending deformation member that opens toward the periphery from a center of the rear foot part, Young's modulus of a material forming the bending deformation member is larger than that of a material forming the midsole and that of a material forming the outer sole, the bending deformation member comprises a lower plate portion that is joined to the upper surface of the outer sole, an upper plate portion that is joined to the bottom surface of the midsole and that forms a predetermined opening angle with respect to the lower plate portion, and a curved portion that connects the lower plate portion and the upper plate portion, wherein the lower plate portion, the upper plate portion and the curved portion are integrally formed and continuous with each other and produced from a non-foam synthetic resin, the lower and upper plate portions have respective opposed surfaces opposed to each other, the opposed surface of the lower plate portion and the opposed surface of the upper plate portion gradually getting away from each other as a distance from the curved portion increases, a compression deformation member is fit between the lower and upper plate portions, the compression deformation member deforming so as to store a force of restitution while being compressed, the curved portion of the bending deformation member extends along at least a medial periphery, a rear end periphery, or a lateral periphery of the rear foot part, and when an impact force of landing is loaded to the bending deformation member, the lower plate portion and/or the upper plate portion rotates about the curved portion with the compression deformation member being compressed, whereby the opening angle decreases.

19. A shock absorbing device for a shoe sole comprising: an outer sole having a ground contact surface that contacts a ground and an upper surface opposite to the ground contact surface;

a midsole having a bottom surface, the midsole placed above the outer sole; and a deformation element placed between the outer sole and the midsole, wherein the deformation elements is positioned at least partially at a periphery of a rear foot part, the deformation element includes a bending deformation member that opens toward the periphery from a center of the rear foot part, Young's modulus of a material forming the bending deformation member is larger than that of a material forming the mid sole and that of a material forming the outer sole, the bending deformation member comprises a lower plate portion that is joined to the upper surface of the outer sole, an upper plate portion that is joined to the bottom surface of the midsole and that forms a predetermined opening angle with respect to the lower plate portion, and a curved portion that connects the lower plate portion and the upper plate portion, wherein the lower plate portion, the upper plate portion and the curved portion are integrally formed of synthetic resin, the lower and upper plate portions have respective opposed surfaces opposed to each other, the opposed surface of the lower plate portion and the opposed surface of the upper plate portion gradually getting away from each other as a distance from the curved portion increases, a compression deformation member is fit between the lower and upper plate portions, the compression deformation member deforming so as to store a force of restitution while being compressed, the compression deformation member gradually increases in thickness as the distance from the curved portion increases, and wherein a protruding portion is provided on an upper surface or a lower surface of the compression deformation member, and a through hole with which the protruding portion is engaged is provided in the bending deformation member, when an impact force of landing is loaded to the bending deformation member, the lower plate portion and/or the upper plate portion displaces or deflects in such a manner as to rotate about the curved portion with the compression deformation member being compressed so that the opening angle decreases, whereby a force of restitution is stored in the bending deformation member.

20. A shock absorbing device for a shoe sole comprising: an outer sole having a ground contact surface that contacts a ground and an upper surface opposite to the ground contact surface; a midsole having a bottom surface, the midsole placed above the outer sole; and a deformation element placed between the outer sole and the midsole, wherein the deformation element is positioned at least partially at a periphery of a rear foot part, the deformation element includes a bending deformation member that opens toward the periphery from a center of the rear foot part, the bending deformation member being generally V-shaped or U-shaped in section, Young's modulus of a material forming the bending deformation member is larger than that of a material forming the midsole and that of a material forming the outer sole, the bending deformation member comprises a lower plate portion that is joined to the upper surface of the outer sole, an upper plate portion that is joined to the bottom surface of the midsole, and a curved portion that connects the lower plate portion and the upper plate portion, wherein the lower plate portion, the upper plate portion and the curved portion are integrally formed of synthetic resin, a compression deformation member is fit between the lower and upper plate portions, the compression deformation member deforming so as to store a force of restitution while being compressed, the bending deformation member is provided at least at a region from one side of a medial side and a lateral side of the rear foot part to a rear end of the rear foot part, and the lower plate portion is separated in a longitudinal direction at the region between the one side and the rear end, wherein a connecting member for connecting the midsole and the bending deformation member is interposed between the midsole and the bending deformation member, and the connecting member is formed in a loop shape so as to be continuous at the medial side, the rear end, the lateral side and a front end of the rear foot part.

21. A shock absorbing device for a shoe sole according to claim 20, wherein a second reinforcing part for reinforcing an arch of the shoe sole is formed integrally with the connecting member.

22. A shock absorbing device for a shoe sole comprising: an outer sole having a ground contact surface that contacts a ground and an upper surface opposite to the ground contact surface; a midsole having a bottom surface, the midsole placed above the outer sole; and a deformation element placed between the outer sole and the midsole, wherein the deformation element is positioned at least partially at a periphery of a rear foot part, the deformation element includes a bending deformation member that opens toward the periphery from a center of the rear foot part, the bending deformation member being generally V-shaped or U-shaped in section, Young's modulus of a material forming the bending deformation member is larger than that of a material forming the midsole and that of a material forming the outer sole, the bending deformation member comprises a lower plate portion that is joined to the upper surface of the outer sole, an upper plate portion that is joined to the bottom surface of the midsole, and a curved portion that connects the lower plate portion and the upper plate portion, wherein the lower plate portion, the upper plate portion and the curved portion are integrally formed of synthetic resin, a compression deformation member is fit between the lower and upper plate portions, the compression deformation member deforming so as to store a force of restitution while being compressed, the bending deformation member is provided at least at a region from one side of a medial side and a lateral side of the rear foot part to a rear end of the rear foot part, and the lower plate portion is separated in a longitudinal direction at the region between the one side and the rear end, wherein a connecting member for connecting the midsole and the bending deformation member is interposed between the midsole and the bending deformation member, and Young's modulus of a material forming the connecting member is larger than that of the material forming the midsole and smaller than that of the material forming the bending deformation member.

23. A shock absorbing device for a shoe sole comprising: an outer sole having a ground contact surface that contacts a ground and an upper surface opposite to the ground contact surface; a midsole having a bottom surface, the midsole placed above the outer sole; and a deformation element placed between the outer sole and the midsole, wherein the deformation elements is positioned at least partially at a periphery of a rear foot part, the deformation element includes a bending deformation member that opens toward the periphery from a center of the rear foot part, the bending deformation member being generally V-shaped or U-shaped in section, Young's modulus of a material forming the bending deformation member is larger than that of a material, forming the midsole and that of a material forming the outer sole, the bending deformation member comprises a lower plate portion that is joined to the upper surface of the outer sole, an upper plate portion that is joined to the bottom surface of the midsole, and a curved portion that connects the lower plate portion and the upper plate portion, wherein the lower plate portion, the upper plate portion and the curved portion are integrally formed of synthetic resin, a compression deformation member is fit between the lower and upper plate portions, the compression deformation member deforming so as to store a force of restitution while being compressed, the bending deformation member is provided at least at a region from one side of a medial side and a lateral side of the rear foot part to a rear end of the rear foot part, and the lower plate portion is separated in a longitudinal direction at the region between the one side and the rear end, wherein a protruding portion is provided on an upper surface or a lower surface of the compression deformation member, and a through hole with which the protruding portion is engaged is provided in the bending deformation member.

* * * * *